US008353133B2

(12) United States Patent
Arteon

(10) Patent No.: US 8,353,133 B2
(45) Date of Patent: Jan. 15, 2013

(54) ANCHOR FOR HANDLING CONSTRUCTION ELEMENTS COMPRISING FIXED DIVERGENT ARMS

(76) Inventor: Marcel Arteon, Bayonne (FR)

( * ) Notice: Subject to any disclaimer, the term of this patent is extended or adjusted under 35 U.S.C. 154(b) by 150 days.

(21) Appl. No.: 12/865,425

(22) PCT Filed: Feb. 9, 2009

(86) PCT No.: PCT/FR2009/050207

§ 371 (c)(1),
(2), (4) Date: Sep. 3, 2010

(87) PCT Pub. No.: WO2009/101353

PCT Pub. Date: Aug. 20, 2009

(65) Prior Publication Data

US 2011/0000148 A1 Jan. 6, 2011

(30) Foreign Application Priority Data

Feb. 8, 2008 (EP) ..... 08300079

(51) Int. Cl.
*E02D 35/00* (2006.01)
*E04G 21/14* (2006.01)
*E04H 12/34* (2006.01)

(52) U.S. Cl. ..... 52/125.5; 52/125.4; 52/124.2; 52/704; 52/707

(58) Field of Classification Search ..... 52/124.2, 52/125.4, 125.5, 704, 705, 706, 707, 708, 52/709, 710
See application file for complete search history.

(56) References Cited

U.S. PATENT DOCUMENTS

| | | | | | |
|---|---|---|---|---|---|
| 977,753 | A | * | 12/1910 | Schumann | 52/261 |
| 1,989,811 | A | | 2/1935 | Kulp et al. | |
| 2,588,631 | A | | 3/1952 | James | |
| 2,724,165 | A | | 11/1955 | Williams | |
| 3,095,672 | A | | 7/1963 | Di Tullio et al. | |
| 3,234,703 | A | * | 2/1966 | Sullivan, Jr. | 52/509 |
| 3,290,983 | A | | 12/1966 | Peterson | |
| 3,339,328 | A | | 9/1967 | Hinchliffe | |
| 4,086,014 | A | | 4/1978 | Jalaguier | |
| 4,720,952 | A | | 1/1988 | Fricker | |
| 4,756,136 | A | | 7/1988 | Hodges | |
| 4,924,648 | A | * | 5/1990 | Gilb et al. | 52/295 |
| 5,011,440 | A | | 4/1991 | Lee | |
| 5,096,444 | A | | 3/1992 | Lu et al. | |
| 5,596,846 | A | | 1/1997 | Kelly | |
| 5,625,993 | A | | 5/1997 | Kelly | |
| 5,743,062 | A | * | 4/1998 | Fricker | 52/704 |
| 6,071,144 | A | | 6/2000 | Tang | |
| 6,125,604 | A | | 10/2000 | Holmes | |
| 6,334,284 | B1 | | 1/2002 | Provitola | |

(Continued)

FOREIGN PATENT DOCUMENTS

AU 199894225 B2 6/1997

(Continued)

*Primary Examiner* — Jeanette E Chapman
*Assistant Examiner* — James Buckle, Jr.
(74) *Attorney, Agent, or Firm* — Leydig, Voit & Mayer

(57) ABSTRACT

An anchor for construction elements, such as concrete panels, and including at least one flat part, an upper part for hanging on a handling engine and extending along a principal plane and a lower part for anchoring in the construction element. The lower part has two arms diverging in the direction of the lower end of the anchor, extending outside the principal plane, and forming, between them, an angle.

14 Claims, 8 Drawing Sheets

U.S. PATENT DOCUMENTS

| | | | | |
|---|---|---|---|---|
| 6,393,789 | B1 | 5/2002 | Lanclos | |
| 7,111,432 | B2 * | 9/2006 | Hansort | 52/125.4 |
| 7,237,368 | B2 * | 7/2007 | Richardson et al. | 52/707 |
| 2005/0055958 | A1 | 3/2005 | Hansort | |
| 2012/0067001 | A1 | 3/2012 | Arteon | |

FOREIGN PATENT DOCUMENTS

| | | | |
|---|---|---|---|
| AU | 200027607 | B2 | 10/2000 |
| DE | 12 15 870 | B | 5/1966 |
| EP | 1 712 705 | A2 | 10/2006 |
| FR | 2 177 488 | A | 11/1973 |
| FR | 2 749 603 | A1 | 12/1997 |
| GB | 800302 | | 8/1958 |
| NZ | 221730 | | 9/1987 |
| WO | WO 90/10764 | A1 | 9/1990 |

* cited by examiner

Fig.15
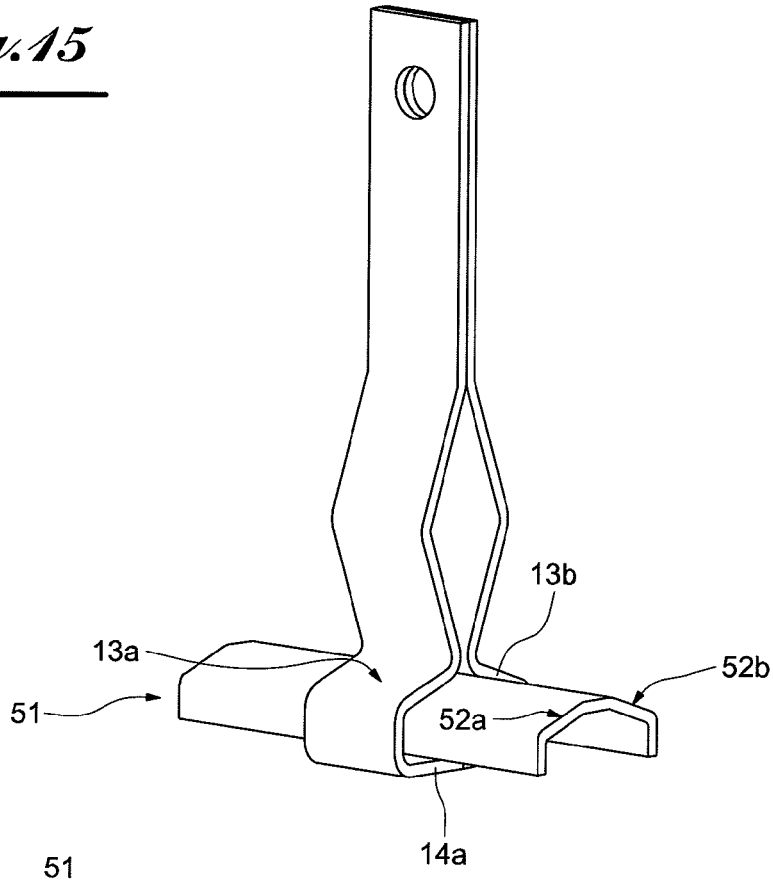
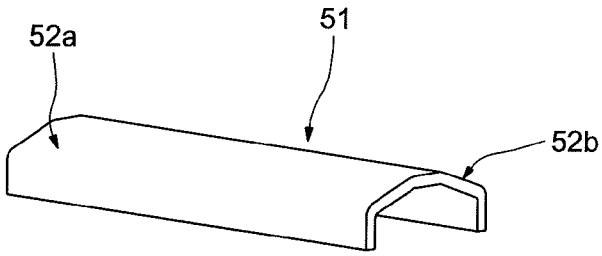
Fig.16
Fig.17
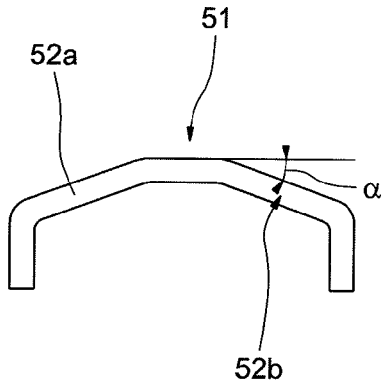

Fig.18
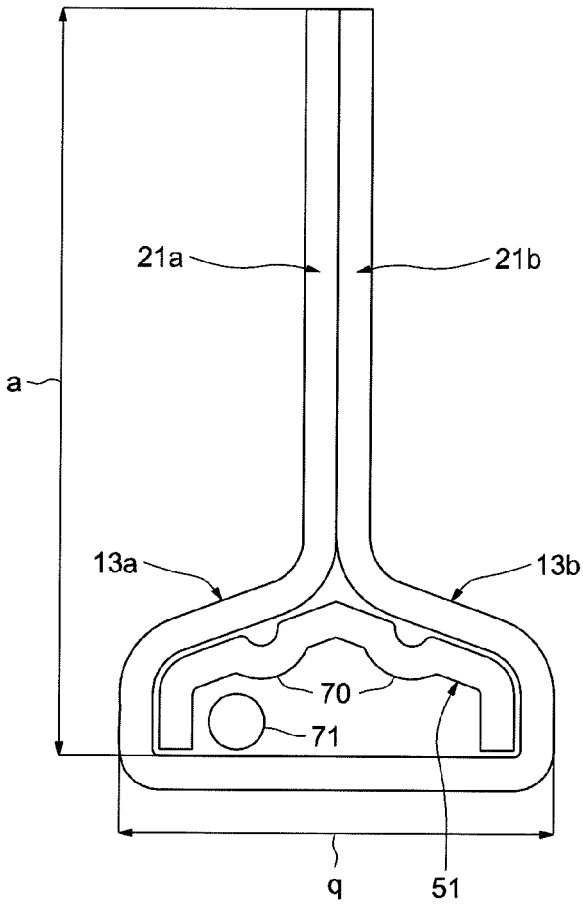
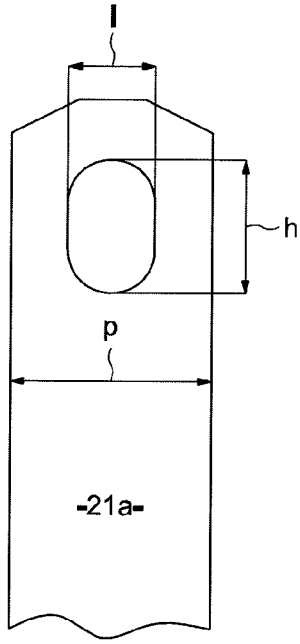
Fig.19
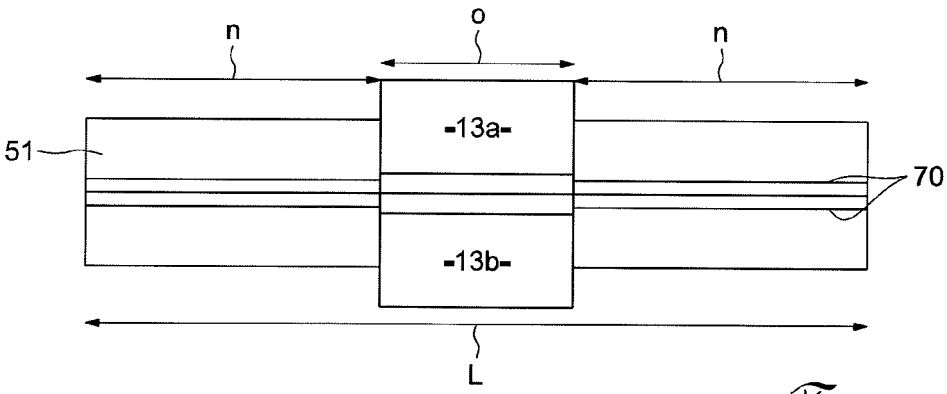
Fig.20

ANCHOR FOR HANDLING CONSTRUCTION ELEMENTS COMPRISING FIXED DIVERGENT ARMS

FIELD OF THE INVENTION

The invention concerns a handling anchor for construction elements such as prefabricated blocks and panels, in particular in concrete or in compound material, designed to be fixed to a construction element to facilitate its handling, for the purpose of its movement.

BACKGROUND

One commonly used anchor of this type is a dovetail anchor.

It is made up of a flat section whereof the upper part defines a gripping head which provides a link between the construction element and a handling engine designed to move it, the central part defines and body and the lower part, a foot.

The body and the foot are designed to be submerged within the material making up the construction panel and to adhere to this panel so that the anchor and the construction element form a transportable single assembly.

The dovetail shape is defined by the foot of the anchor which comprises two arms divergent in relation to each other along the direction opposite that of lifting, which define two support surfaces for the parts of the panel located above these arms, and thus a certain anchoring capacity.

During lifting, these arms consequently support the majority of the weight of the panel and the part of the panel interposed between these arms is the seat of significant compressive forces.

Under these conditions, it is possible for the angle of these arms in relation to the principal plane of the flat section to decrease, which results in a change in the anchoring capacity developed by these arms.

SUMMARY OF THE INVENTION

The invention aims to resolve this drawback, economically while ensuring high performances and safety level, without adding any complementary frame under axial tension.

To this end, the invention concerns a handling anchor for construction elements, such as concrete panels, formed from at least one flat section, comprising an upper part for hanging on a handling engine, extending along a principal plane (P) and a part forming the body of the anchor and a part forming the foot of the anchor and designed to ensure anchoring in the construction element, this foot comprising two arms diverging in the direction of the lower end of the anchor and extending outside the principal plane (P) and forming, between them, a predetermined angle (γ), the diverging arms define a compression cone during the lifting of the construction element.

According to the invention, the anchor comprises at least one flat part connecting the two arms to each other to ensure maintenance of the predetermined angle (γ) between these two arms, and to form with the diverging arms, a stiffening case localized at the foot of the anchor.

According to another characteristic, it comprises two flat parts each integral with the lower end of one diverging arm, these two flat parts converging toward one another in the direction of the lower end of the anchor and being in contact with each other along their lower edges and defining converging arms for maintaining the predetermined angle (γ).

Advantageously, the two convergent arms are integral with each other by their lower edges.

Preferably, the anchor is formed from two flat sections, each comprising consecutive parts separated two by two by bending lines and defining a head part, a divergent arm and a maintenance arm, the first and second flat sections being arranged back-to-back.

According to another characteristic, the anchor is formed from a single flat section comprising consecutive parts separated two by two by bending lines and defining a first head part, a first divergent arm, a first maintenance arm, a second maintenance arm, a second divergent arm and a second head part.

According to another embodiment, it comprises, interposed between the head and the diverging arms, two opposite flat parts diverging in relation to each other in the direction of the end of the anchor forming active facets which, when the anchor is fixed to the construction element, ensure adhesion of said anchor to the construction material.

Moreover, it may comprise, interposed between the active facets and the diverging arms, intermediate facets converging towards each other in the direction of the anchor or parallel to each other.

Preferably, the diverging arms are at an angle in relation to the principal plane (P) by an angle between 45° and 80°.

When the diverging arms are angled in relation to the principal plane (P) by an angle substantially equal to 45°, the two active arms and the two maintenance arms can define a rectangular contour, preferably square.

In another case, the active arms each comprise a portion at an angle in relation to the principal plane (P) by an angle substantially equal to 70°, and a vertical portion parallel to the principal plane (P), consecutive to the angled portion, the maintenance arms each extending from a vertical portion.

According to another characteristic, the two flat parts forming the head are stuck against each other and comprise orifices for the passage of a lifting ring.

Differently, the two flat parts forming the head are separated from each other, the anchor comprising, for example, a cylindrical head interposed between the two flat parts.

According to another characteristic, two successive flat parts of the stiffening case define two by two an angle equal to or greater than 90°.

According to still another characteristic, the flat part consists of steel.

Preferably, the anchor comprises two raising fins extending along a longitudinal edge of the body of the flat part, each fin defining a tilt angle with the body of the flat part.

The invention also concerns a device for lifting and/or raising construction elements, comprising an anchor as defined above and an extension element having the general shape of a profile, provided with at least two opposite faces with a same tilt as the diverging arms of the anchor, and conformed so as to be able to cross the cavity defined by the stiffening case of the anchor and to extend on either side of this case with each of its two tilted faces extending the corresponding diverging arm according to the same tilt.

BRIEF DESCRIPTION OF DRAWING FIGURES

The invention will be better understood and other aims, details and advantages thereof will appear more clearly upon reading the following description, done in reference to the appended drawings, provided solely as an example, in which.

Figure 6:
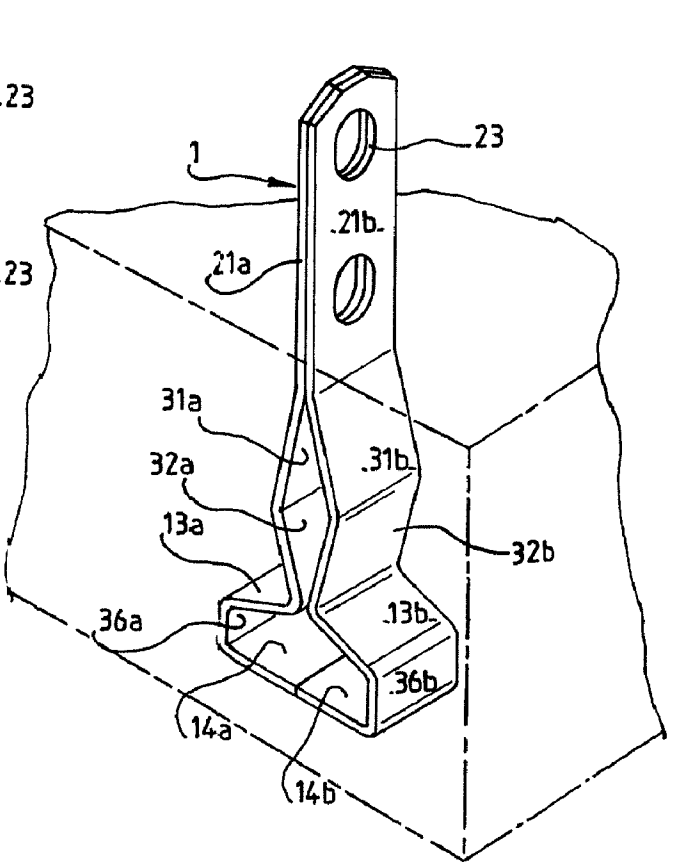
Figure 4:
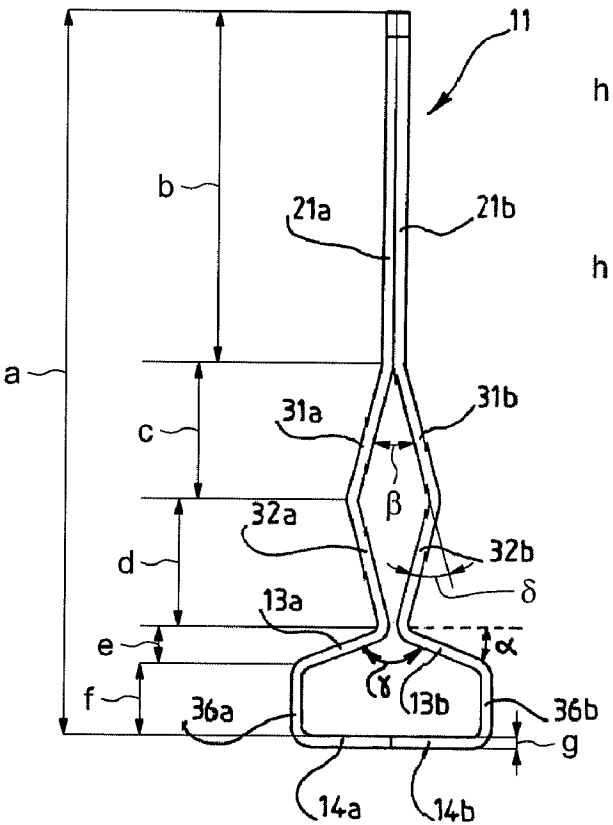
FIG. 4 shows a front view of an anchor according to a third embodiment of the invention.
Figure 9:
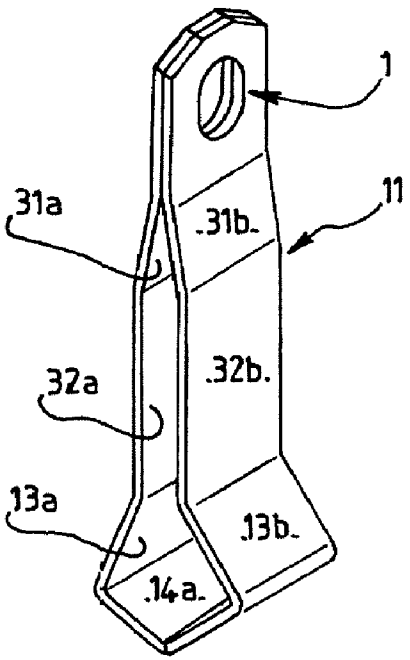
Figure 8:
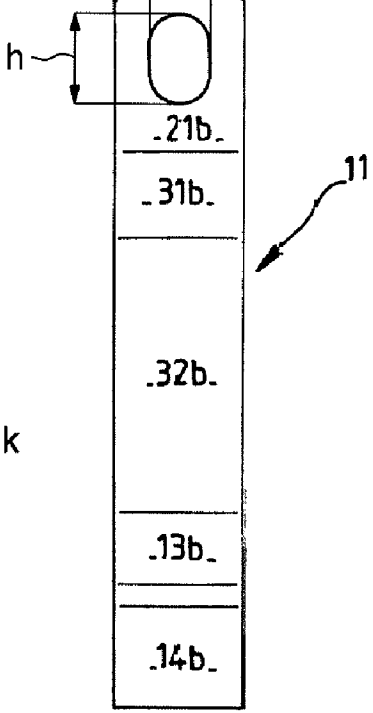
Figure 7:
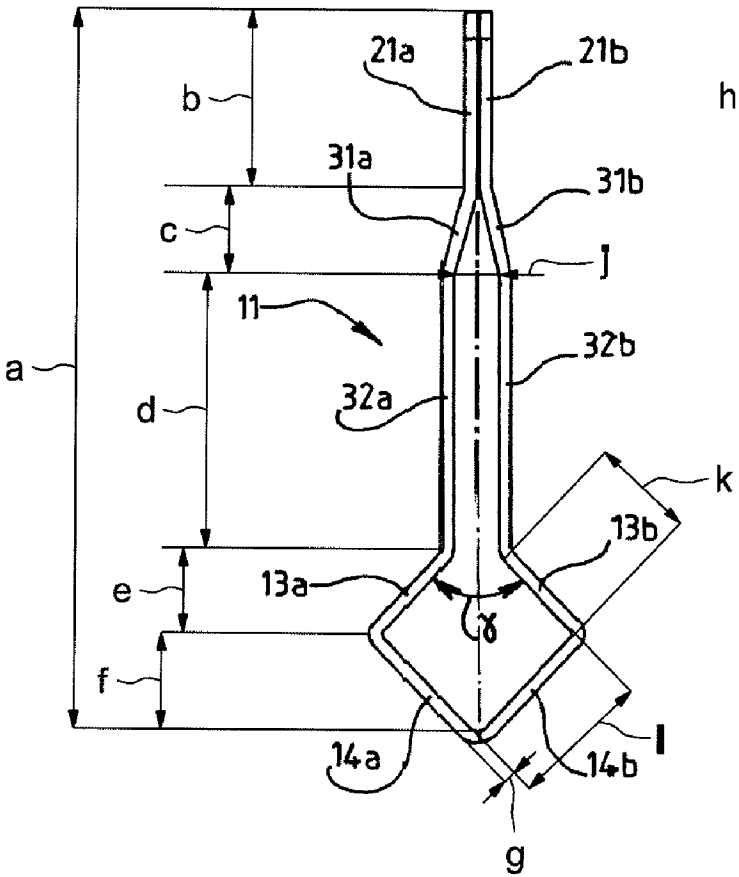
Figure 12:
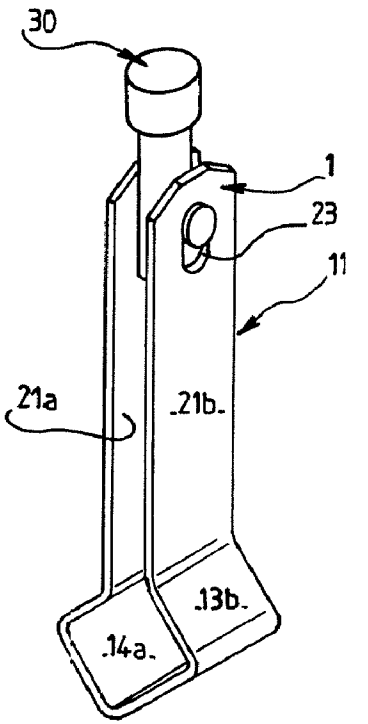
Figure 11:
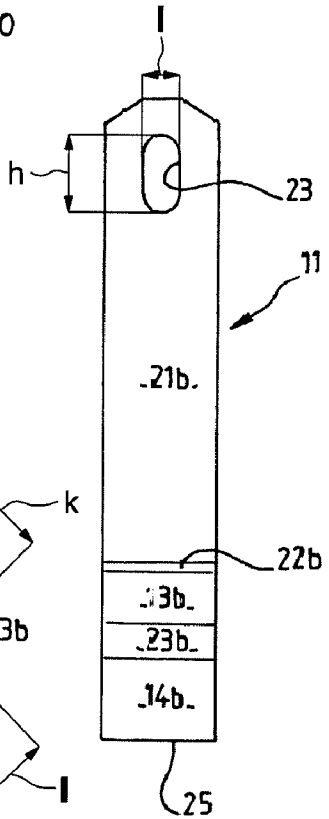
Figure 10:
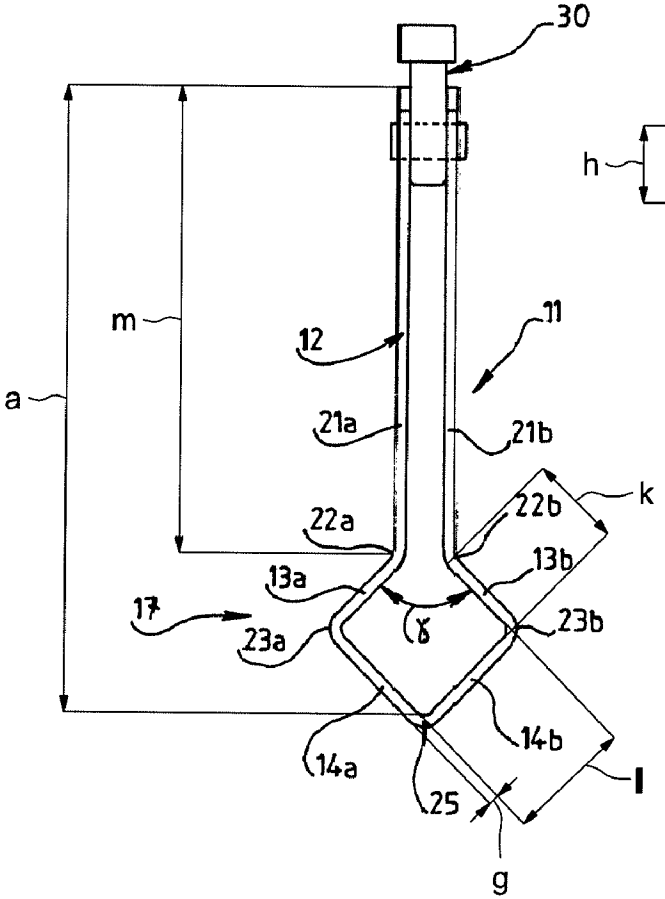

FIG. 6 corresponds to a perspective view of the anchor from FIG. 4;

FIGS. 7, 8 and 9 are front, side and perspective views, respectively, of a third possible variation of embodiment of the anchor according to the invention;

FIGS. 10, 11 and 12 are front, side and perspective views, respectively, of a fourth possible variation of embodiment of the anchor according to.

Figure 13:
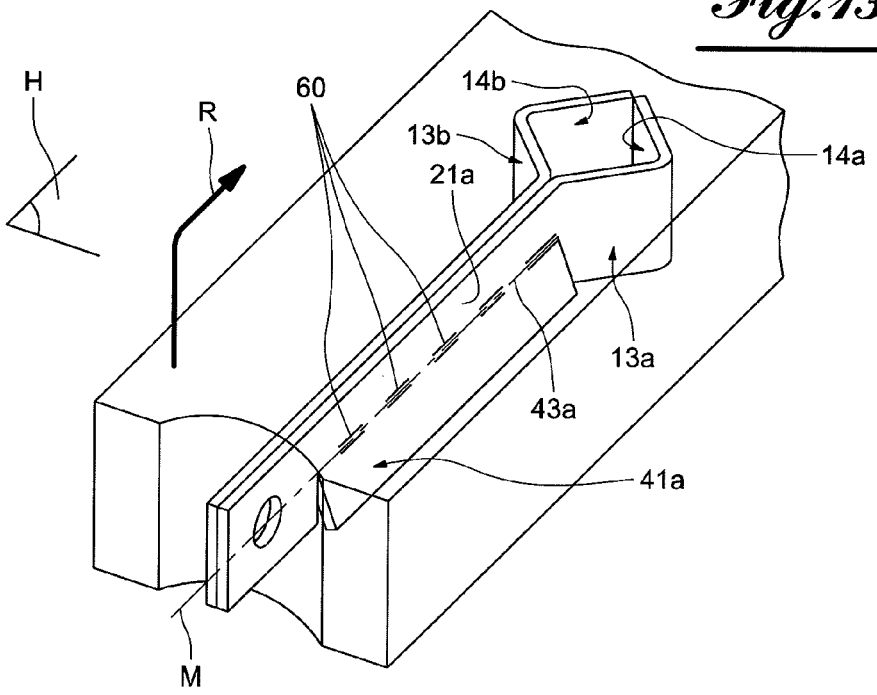
Figure 14:
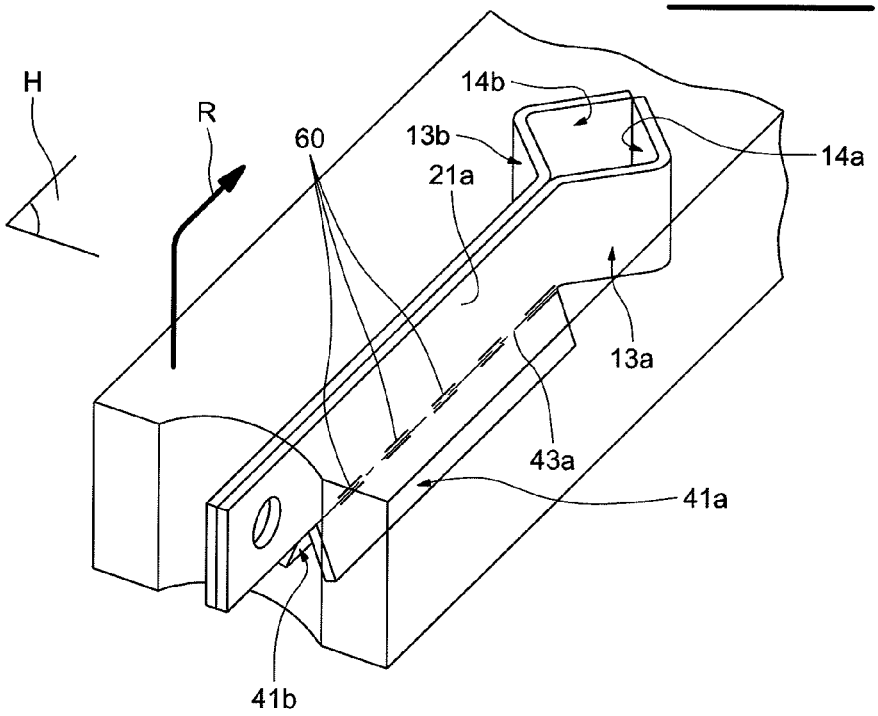

FIGS. 13 and 14 represent another possible variation of embodiment of the invention.

FIGS. 15 to 20 illustrate another possible variation of embodiment of the invention.

DETAILED DESCRIPTION

The anchor devices according to the invention were designed to enable handling, in particular lifting, of construction elements such as prefabricated concrete blocks or panels.

Figure 1:
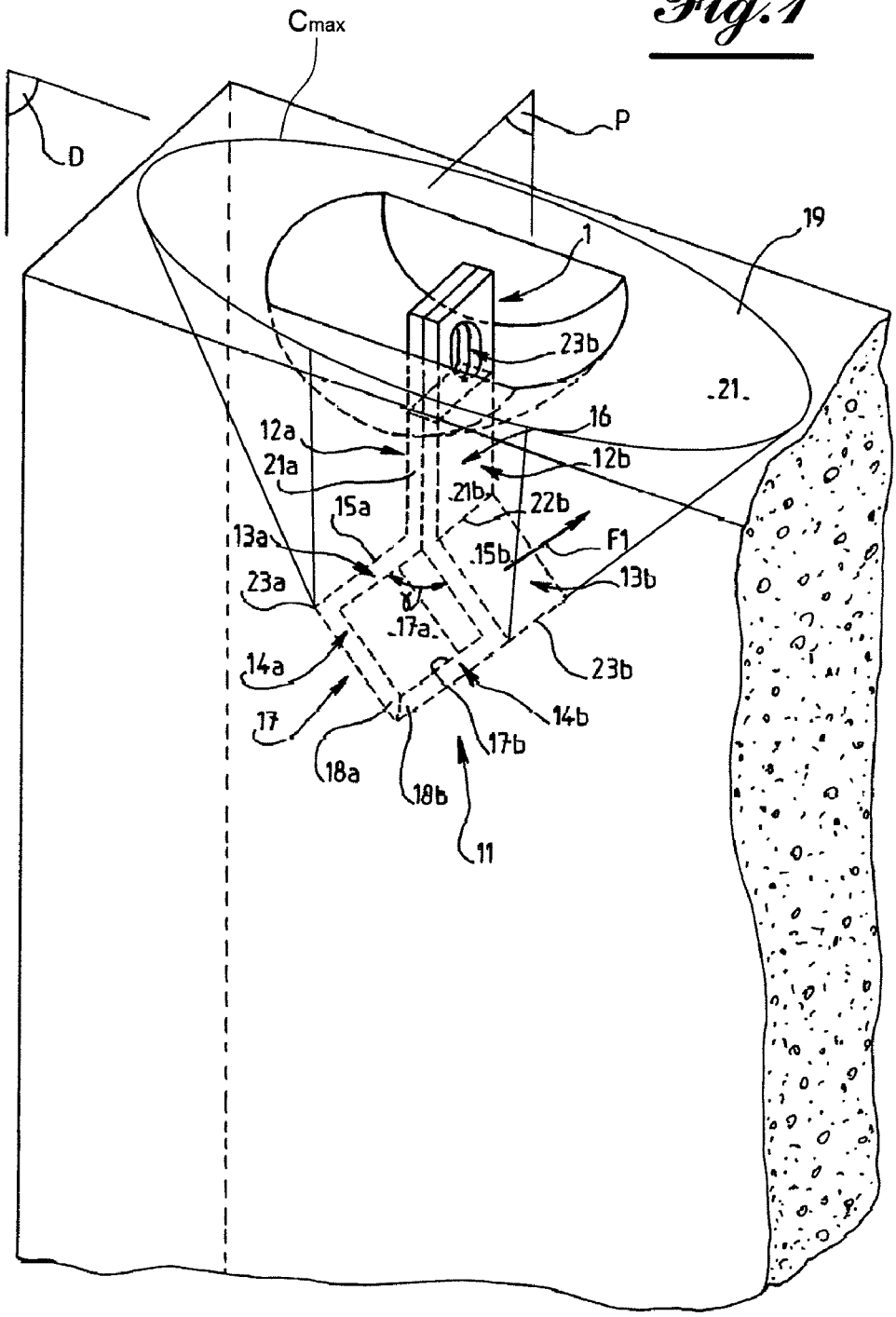
FIG. 1 illustrates a perspective view of an anchor according to a first embodiment of the invention, in position within a construction panel for the purpose of its lifting.

FIG. 1 shows a first embodiment of an anchor according to the invention generally designated by the reference 11.

It comprises a head part 1, a part 16 forming the body of the anchor and a part 17 forming the foot.

The anchor 11, with the exception of the head 1 which remains outside the material of the construction element and is adapted to be hung on a handling engine, is designed to be embedded in the material forming the construction element whereof the anchor facilitates handling.

In general, this construction element can be a concrete slab or panel 19 and the head 1 of the anchor is accessible from a free section 21 of the panel 19 within which a recess 22 or "reservation" has been formed allowing the head 1 to go past the anchor, while the body 16 and the foot 17 of the anchor are embedded in the concrete.

The anchor 11 according to FIG. 1 is made from two identical flat parts 12*a*, 12*b*, i.e. two stiff strips for example in metal whereof the thickness is small in relation to the width, which are each bent to define an active arm extending outside the principal plane of the flat part.

Each flat part is arranged in the panel such that its width is in the direction of the thickness of the panel.

The diverging arms define active surfaces 15*a*, 15*b* which, combined with the developed surface of the flat part, make it possible to urge the concrete both to adhesion and shearing to the right of the anchors created by the facets.

Due to their tilt in relation to a horizontal plane and to their depth within the concrete in relation to the head of the anchor since they are positioned at the foot of the anchor, these arms 13*a*, 13*b* define, upon lifting, a compression cone centered on the principal plane of the anchor, whereof the top is located toward the foot of the anchor and whereof the base extends around the head of the anchor. The amplitude of the base of the compression cone is more significant when the tilt a of one arm 13*a*, 13*b* is close to 45°, and weaker when this tilt is close to a horizontal plane, i.e. 0° tilt.

According to the invention, in order to keep the tilt of the diverging arms fixed in relation to the longitudinal plane P of the flat section upon lifting of the panel, the anchor 11 comprises two arms converging towards each other 14*a*, 14*b*, horizontally or along two intersecting planes and each extending in the extension of a diverging arm 13*a*, 13*b* in the direction of the foot of the anchor.

The two convergent arms 14*a*, 14*b* define, for the divergent arms 13*a*, 13*b* which they extend, means for maintaining the tilt of these divergent arms.

Indeed, the convergent arms in contact 14*a*, 14*b* act on the divergent arms 13*a*, 13*b* like stiffening members to avoid bending of these arms 13*a*, 13*b* under the effect of the weight exerted by the concrete overhanging these arms 13*a*, 13*b* during lifting of the concrete panel.

Moreover, the two convergent arms 14*a*, 14*b* are in contact with each other by their edges 18*a*, 18*b* opposite the divergent arms 13*a*, 13*b*, to define, with these divergent arms 13*a*, 13*b*, a deformation-resistant case, for example having a square transverse cross-section.

The contact edges 18*a*, 18*b* of the convergent portions 14*a*, 14*b* of the anchor are advantageously fixed to each other. This fixing is done, for example, by welding via a lug, or by bending when the anchor is made up of a single flat part.

Thus, contrary to the case of the aforementioned dovetail anchor, the tilt of the divergent arms 13*a*, 13*b* does not tend to change in relation to the principal plane P of the flat part and the concrete interposed between the two opposite arms 13*a*, 13*b* is not overcompressed.

Moreover, the internal surfaces 17*a*, 17*b* of the convergent arms 14*a*, 14*b* participate in the adhesion between the concrete and this anchor.

By the presence of the arms 14*a*, 14*b* which ensure maintenance of the tilt of the diverging arms 13*a*, 13*b*, the anchoring cone defined by these diverging arms 13*a*, 13*b* may be maintained constant.

For example, with these maintenance arms 14*a*, 14*b*, it is possible to maintain the anchoring cone constant with significant amplitude $C_{max}$ defined by 45°—tilted arms, which is schematically illustrated in FIG. 1. Such a cone of amplitude $C_{max}$ defines a significant anchoring or lifting capacity since it develops a volume of concrete as great as possible (volume defined by the cone $C_{max}$).

It is therefore particularly adapted to the lifting of very heavy elements of the order of 5 to 10 tons, for example.

Also, they give the possibility of maintaining a cone constant with lesser amplitude obtained with diverging arms 13*a*, 13*b*, tilted by only 20° in relation to the horizontal which is illustrated in FIG. 6. The anchoring capacity of this cone is lower than that of the cone of the anchor of FIG. 1 since the volume of concrete developed by 20°—tilted arms is less than that developed by 45°—tilted arms.

But in both cases, the amplitude of the cone remains constant because of the presence of the arms 14*a*, 14*b*, maintaining the tilt of the diverging arms 13*a*, 13*b*, so that the anchor lifting force remains constant during the lifting of the construction element and/or subsequently to successive liftings.

The stiffening case, regardless of its shape, defines the foot of the anchor which is the active element in the concrete while generating compression areas upon the lifting.

The anchoring depth, i.e. the depth at which the case is found relative to the upper part of the concrete construction element determines the resistance value of the anchoring in the concrete.

There is in fact a correlation between the mechanical strength value and the anchoring depth.

Below, we describe different embodiments of anchors according to the invention.

The anchors from FIGS. 1 to 3 and 7 to 12 comprise two divergent arms 13*a*, 13*b* arranged at the foot of the anchor i.e. for example at least 120 mm from the head of the anchor (see Table 1 below) and are intended to extend to at least a depth of 130 mm in the construction element.

These arms 13*a*, 13*b* are tilted at a 45° angle in relation to the horizontal direction and the convergent arms 14*a*, 14*b* define a right angle with the divergent arms 13*a*, 13*b*.

Thus, the case formed by the divergent 13*a*, 13*b* and convergent 14*a*, 14*b* arms has a square-shaped cross-section with relatively short sides. This square case extends in the construction element to be lifted with its diagonal parallel to the direction of lifting. Due to this square cross-section, the case is very stiff and practically deformation-resistant. And due to the 45° angle, the developed compression cone is significant.

Figure 5:
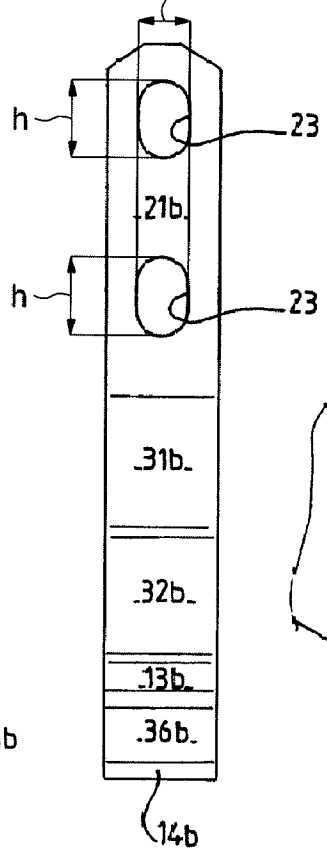
FIG. 5 is a side view of the anchor from FIG. 4.

The anchor in FIGS. 4 to 6, on the other hand, comprises two divergent arms always arranged at the foot of the anchor but defining an angle α of 20°.

This anchor comprises intermediate facets 31*a*, 31*b*, 32*a*, 32*b* which increase the adhesion surface of the anchor.

Furthermore, in this embodiment, the arms for maintaining the tilt angle of the diverging arms 14*a*, 14*b* extend along a horizontal plane and not a plane tilted at 45° as this is the case for the arms 14*a*, 14*b* of FIGS. 1 to 3 and 7 to 12.

These horizontal arms 14*a*, 14*b* are therefore closer to the divergent arms tilted at 20° in FIG. 4 than are the converging arms 14*a*, 14*b* of the 45°—tilted arms of FIG. 1, and thus define a case having a small height but which is still deformation-resistant. Thanks to this small height of the case, for a same length of body anchor, the anchor of FIG. 4 has a total length smaller than that of FIG. 7 and is particularly adapted to the transport of concrete slabs along a horizontal plane since in this case, the anchor extends along the smallest dimension of the slab, i.e. the thickness (see FIG. 6).

Moreover, for a same total anchor length, still due to the short case resulting from the 20° tilt of the divergent arms 13*a*, 13*b* and from the horizontality of the maintenance arms 14*a*, 14*b*, the divergent arms 13*a*, 13*b* at a tilt of 20° may be arranged closer to the lower end of the anchor than in the case of FIG. 7, the divergent arms of which are at a tilt of 45° and the maintenance arms are not horizontal but converge along two intersecting planes towards the lower edge of the anchor. The 20°—tilted arms of the anchor of FIG. 4 are therefore able to be arranged more deeply in a slab or a panel, than the divergent arms 13*a*, 13*b* of the anchor from FIG. 7. These 20°—tilted arms 13*a*, 13*b* being more deeply anchored in the concrete, may develop a comparable or even greater anchoring capacity than that of the 45°—tilted arms from FIG. 7, although the latter develop a more significant anchoring cone.

Each variation of embodiment will now be described in further detail.

According to the exemplary embodiment shown in FIG. 1, the anchor is formed by connecting two identical flat parts 12*a*, 12*b*, coming from a metallic strip which is smooth, as shown, or ribbed according to a non-illustrated embodiment.

Each flat part 12*a*, 12*b* is bent along two bending lines, to provide the flat part 12*a*, 12*b* with a principal part extending along a principal plane P, an active arm 13*a*, 13*b* extending outside the principal plane and a maintenance arm 14*a*, 14*b* extending the active arm and returning toward the principal plane.

Figure 2:
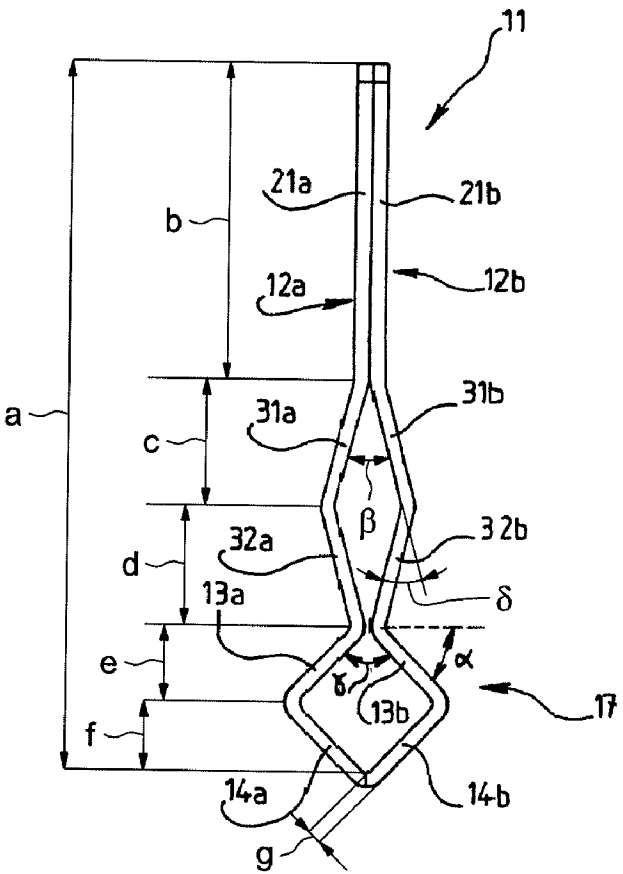
FIG. 2 shows a front view of an anchor according to a second embodiment of the invention.

As the different parts of the right flat part 12*b* in FIG. 2 are more visible than those of the left flat part 12*a*, it is the right flat part 12*b* which will be described below, this description of course being valid for the left flat part 12*a* as well.

The first bending line 22*b* defines, for the flat part 12*b*, the principal part 21*b*, extending along the principal plane P and designed to be stuck against the corresponding part 21*a* of the second flat part 12*a*. This principal part 21*b* bears, at its upper end, an orifice 23*b* into which a handling hook is designed to be engaged.

The active arm 13*b* extending from the bending line 22*b* outside the principal plane P defines, with the principal part 21*b* of the flat part 12*b*, an angle of approximately 135°.

Thus, in relation to a horizontal plane, the active surface of the divergent arm 15*b* is tilted by 45°.

As mentioned above, the divergent arms 15*a*, 15*b* generate, in the concrete, during lifting, a compression cone of significant amplitude, due to the 45° tilt relative to the horizontal plane of the divergent arms.

And the deformation-resistant case 17 formed by the active divergent arms and the convergent reinforcing arms, makes it possible to keep the tilt of the divergent arms fixed in relation to a horizontal plane.

In the embodiment illustrated in FIGS. 10 to 12, the anchor still comprises a deformation-resistant end case 17 positioned at the foot of the anchor but it is made from a single flat part 12 bent on itself. This single flat part is bent along the bending lines 22*b* and 23*b* to define the rectilinear part 21*b*, the aforementioned active arm 13*b* and the convergent arm 14*b*, then bent at 90° along the bend 25 of FIG. 10 to define the lower right corner of the deformation-resistant case 17. The flat part 12 is then bent along the lines 23*a* and 22*a* to define the convergent 14*a*, divergent 13*a* arms and the opposite rectilinear part 21*a*.

Moreover, according to this embodiment, the rectilinear parts 21*a*, 21*b* of the flat section are separated from each other and define a space for receiving a gripping head 30, for example cylindrical, either with a screw or not, or of any other shape adaptable to any gripping means. This separation further causes a greater volume of the foot of the anchor and of the concrete.

Figure 3:
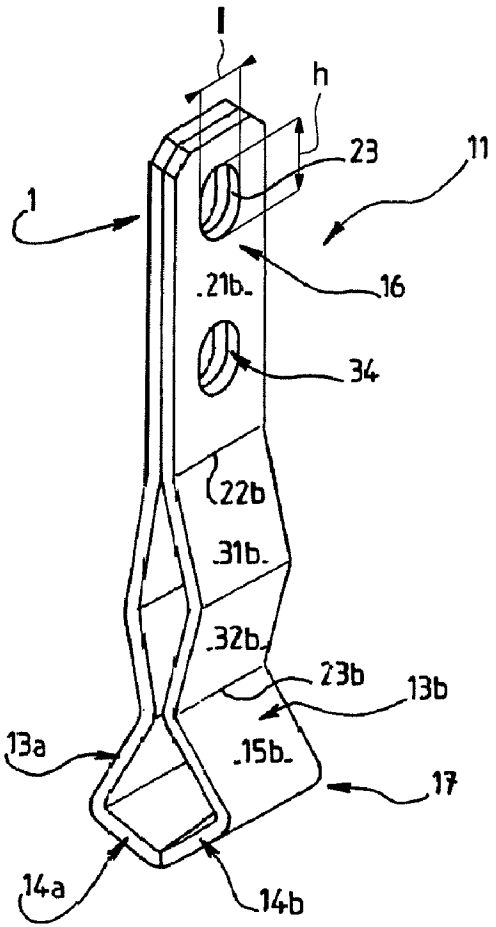
FIG. 3 is a perspective view of the anchor from FIG. 2.

According to the exemplary embodiment illustrated in FIGS. 2 and 3, the anchor 11 is still made by connecting two identical flat sections, but these define an additional case with regard to the embodiment of FIG. 2, interposed between the body 16 of the anchor 11 and the first case 17.

More specifically, each flat section 12*a*, 12*b* comprises four bending lines, separating them in a rectilinear part 21*b*, an upper blade 31*b* extending outside the principal plane defined by the rectilinear part, a lower blade 32*b* returning the flat section toward the principal plane, the aforementioned active arm 13 and the aforementioned strengthening arm 14*b*.

The upper blades 31*a*, 31*b* of the two flat parts diverge in relation to each other in the direction of the foot of the anchor 11 and define an angular opening of approximately 15°. The lower blades 32*a*, 32*b* converge toward each other to be practically in contact with each other. They define support surfaces for the concrete part interposed between the divergent blades 31*a*, 31*b* upon lifting.

The upper blades 31*a*, 31*b* define intermediate active adhesion portions between the anchor and the concrete, which develop a very weak compression cone, given the tilt of approximately 80° of these blades in relation to a horizontal plane.

The anchor comprises, in addition to the orifice 23 for the passage of the handling hook, a passage slit 34 for a metallic reinforcement.

The blades 31*a*, 31*b* and the divergent 13*a*, 13*b* and convergent 14*a*, 14*b* arms combined with the developed surface of the flat part make it possible to bias the concrete both toward adhesion and shearing to the right of the anchors created by the facets.

According to the embodiment shown in FIGS. 7 to 9, the anchor is also made using two identical flat parts defining an end case 17 having a square transverse cross-section, and upper active blades 31*a*, 31*b*, but the lower blades 32*a*, 32*b* do not converge toward each other. They are, on the contrary, parallel to each other. They therefore do not define a support surface for the concrete part interposed between the divergent blades 31*a*, 31*b*, but simply an internal longitudinal volume leading to the square internal volume of the end case 17.

FIGS. 4 to 6 illustrate another embodiment of an anchor formed from two identical metallic flat parts. The particularity of this embodiment resides in particular in the fact that the active divergent arms 13*a*, 13*b* define a tilt angle of approximately 20° relative to a horizontal plane which develops an a priori weaker compression cone than that of the divergent arms at 45° in FIGS. 1 to 3 and 7 to 12.

In this case, each divergent arm 13*a*, 13*b* is extended by a substantially vertical flat portion 36*a*, 36*b*, itself extended by the aforementioned strengthening arm 14*a*, 14*b* which also extends along a horizontal plane.

TABLE 1

Dimensions of the illustrated anchors

| Letter marking the relevant dimension | Anchor FIG. 2 | | Anchor FIG. 4 | | Anchor FIG. 7 | | Anchor FIG. 10 | |
|---|---|---|---|---|---|---|---|---|
| a | 200 | | 185 | | 160 | | 160 | |
| b | 155 | 85 | 160 | 90 | 118 | 40 | 121 | — |
| c | 35 | | 35 | | 78 | | | — |
| d | 35 | | 35 | | | | | — |
| e | 20 | | 9 | | 42 | | — | |
| f | 20 | | 16 | | | | — | |
| g | 4 | | 3 | | 3 | | — | |
| h | 20 | | 20 | | 20 | | 20 | |
| i | 14 | | 14 | | 14 | | 14 | |
| j | — | | — | | 18 | | — | |
| k | — | | — | | 25 | | 25 | |
| l | — | | — | | 30 | | 30 | |
| m | — | | — | | — | | 121 | |

Moreover, according to the variation of embodiment illustrated in FIG. 13 or 14, a square stiffening case anchor as described for FIG. 1 is provided with raising fins 41*a*, 41*b*.

These fins 41*a*, 41*b* are formed by a flat part extending laterally beyond the longitudinal edge 43*a* of the body 21*a* of the anchor, which is bent along a line 43*a* coinciding with the longitudinal edge 43*a* of the body 21*a* in order to form an angle of about 20°.

The two fins 41*a*, 41*b* are symmetrical in relation to the P plane.

These fins 41*a*, 41*b* define concrete compression surfaces during the raising of the construction element in the direction illustrated by the marked arrow R in FIG. 13 or 14.

Ribs 60, schematically illustrated by sets of lines in FIGS. 13 and 14, are punched in the folds of the fins 41*a*, 41*b* and have the purpose of increasing resistance to unfolding, they are located in the angle of the fins.

The example of FIG. 13 is also an anchor provided with a stiffening case and raising fins 41*a* and 41*b* but the lines jointing the latter to the body 21*a*, 21*b* of the anchor pass through the middle axis M of the anchor and transverse slots (only one of which is visible in FIG. 15) are made in the body of the anchor from the longitudinal edge 43*a* up to the middle axis M.

By making the fins 41*a*, 41*b* in the actual body of the flat part it is possible to save material relatively to the fins of the anchor of FIG. 14 which require additional material. But the making of the latter is simpler since it does not require forming slots within the body of the flat part.

The fins 41*a* and 41*b* act in minority in adhesion under axial tension and in majority by developing a compression cone raising the anchoring since they are tilted at 20° as marked in FIGS. 13 and 14.

In the example illustrated in FIGS. 15 to 20, a remedy is found to the a priori small amplitude of the anchoring cone developed by an anchor provided with 20°—tilted diverging arms 13*a*, 13*b*, by extending these arms with an extension element 51, introduced into the stiffening case of the anchor and provided with two faces 52*a*, 52*b* with the same tilt as the diverging arms 13*a*, 13*b*, i.e. tilted by 20° in relation to the horizontal.

The tilted faces 52*a*, 52*b* develop on either side of the stiffening case, anchoring cones of the same amplitude as the cone $C_{inf}$ developed by the stiffening case which increases the anchoring capacity of the anchor.

The extender 51 of FIG. 18 comprises two ribs 70 increasing its stiffness.

One or more frames 71 may be provided additionally.

This extender 51 may for example have a length L of 120 mm and jut out by 45 mm (n) on either side of the stiffening case. The latter may have a width of 30 mm (o), just like the width p of the body of the flat part 21*a* of the anchor.

Comparative studies conducted by numerical simulation have shown that adding the extension element 51 it was possible to increase the performance of the anchor in terms of 33% tensile strength for tensile tests, as illustrated in Table 2 below:

TABLE 2

Comparison of the performances of anchors with and without any extender

| | Anchor without any extender FIG. 6 | | Anchor with extender FIG. 19 | |
|---|---|---|---|---|
| Type of concrete | 15 MPa | 25 MPa | 15 MPa | 25 MPa |
| Tensile strength | 62 kN | 62 kN | 83 kN | 83 kN |
| Type of failure | steel | steel | steel | steel |

An extender of this type may be used as a replacement for the intermediate tilted facets 31*a*, 31*b* illustrated in FIG. 4 which operate with adhesion. Or else, it may be used as an addition to the anchors of FIGS. 1 to 12, mainly for thin slabs and with tilt angles from 20 to 45° by increasing the compression cone and the adhesion.

As illustrated in FIGS. 18 to 20, in this case, the anchor with 20°—tilted diverging arms 13*a*, 13*b* is without any active facets, with the bodies 21*a*, 21*b* of the flat part only extending along a main plane P, and comprises an extension element 51 of the same type as the one described for FIG. 19.

In the illustrated example, the extender extends on either side of the anchor over a length of 120 mm.

The anchor and the extender 51 are maintained in predetermined positions during the casting of the construction element.

The extension element 51 increases the compression cone and more performing and shorter anchoring may thereby be achieved and it may therefore be used in very thin slabs.

It is possible to make by bending of a metal sheet a one-piece anchor defining the head, the body, the stiffening case and the extender element, providing more economical making than when the anchor and the extender are as separate parts.

The particularities of the embodiments of the anchor described above, such as the square sectional shape of the case, the horizontal extension of the converging arms, the 10, 20, . . . 45° tilt of the diverging arms, the presence or the absence of intermediate facets 31, their number, may be combined with each other in order to define optimum anchoring depending on the construction element to be lifted.

Depending on the needs, the anchors according to the invention may include alone or as a combination, either one of the above particularities, i.e.:

intermediate facets 31*a*, 31*b* with variable length and tilts a stiffening case, the diverging arms of which 13*a*, 13*b* are tilted at 45° and develop a significant anchoring cone a case with 20°—tilted diverging arms 13*a*, 13*b* (other figures)

an anchor, the flat part (14*a*, 14*b*) of which ensuring the function of maintaining the tilt angle of the diverging arms 13*a*, 13*b* includes a horizontal portion, this flat part 14*a*, 14*b* may consist of a single part when the anchor is formed by a single flat part, or by two distinct flat parts when the anchor is formed by two combined flat parts or an anchor which includes as a means for maintaining the tilt of the diverging arms 13*a*, 13*b* a portion with various tilted faces two by two an anchor provided with an extension element as an addition or further raising fins as illustrated in FIG. 13 notably.

As shown by the description just provided and the figures, the anchor according to the invention presents major advantages relative to the anchors of the prior art.

It prevents the divergent active arms from bending under the weight of the concrete upon lifting, thanks to the means for maintaining the tilt of these arms, formed by the convergent strengthening arms.

It is particularly adapted to the lifting of thin panels or nets.

Indeed, upon lifting of the concrete panel, the anchoring capacity developed by the arms tilted between 10° and 45° relative to a horizontal plane is more significant than that developed by horizontal arms, i.e. perpendicular to the body of the anchor and having 0° tilt in relation to a horizontal plane. The anchor can therefore have a smaller length than that of anchors of the known type whereof the feet develop a less significant anchoring capacity, and can therefore be located in the direction of the width of a thin panel, or a sheet.

Moreover, the compression force defined by the divergent arms is directed along a normal preferred direction to the active surface of a arm as shown by the arrow F1 in FIG. 1, and is therefore inscribed in the plane D of the concrete slab or panel 19. Thus, contrary to anchors whereof the foot is disc-shaped and deploys, because of its circular shape, forces on all the 360° of the disc, the anchor according to the invention develops compression forces in the direction of the slab having the largest size and therefore never along the direction of smaller size, avoiding breaking in this direction.

Moreover, an anchor of this type is made by a simple and inexpensive manufacturing method, based on the bending of only one or two flat sections.

Moreover, in all of the embodiments, none of the angles between two consecutive facets of the flat section define an acute angle, which avoids any material weakening which would be due to bending and avoids bending rework.

Moreover, in the illustrated embodiments, the angles between diverging arms 13*a*, 13*b* and converging arms 14*a*, 14*b* are equal to or greater than 90°.

Indeed, the thickness of the flat part used, which is selected to be of the order of one millimeter and of at least 3 mm in the illustrated exemplary anchors (see Table 1, line <<c>>), then the anchor used is selected to have a loading capacity of 20 to 50 tons, makes it difficult or even impossible to define an acute angle between a diverging arm 13*a*, 13*b* and the following horizontal or converging arm 14*a*, 14*b*, even with manufacturing of the anchor with two assembled flat parts.

The thickness of the flat part (3, 4, 5, 8 mm or more) in fact defines a mechanical strength if 1, 3, 5 tons or more, with which the anchor may be related to the weight of the construction elements to be handled.

The invention claimed is:

1. An anchor for lifting a construction element in which the anchor is partially embedded, the anchor comprising:

first and second abutting parts symmetrically disposed with respect to a plane passing between the first and second parts, with the first and second parts in contact with each other along at least one line lying in the plane, wherein the first and second parts have a mirror symmetry with respect to the plane, each of the first and second parts includes a head, a body, and a foot that are continuously and contiguously arranged in that order, the heads of the first and second parts include means for engagement by a handling engine for lifting a construction element in which the anchor is partially embedded, the feet of the first and second parts have respective distal ends, the bodies of the first and second parts are joined to the feet of the first and second parts at respective first bends of the first and second parts, the first and second parts diverge from the plane at the first bends to define divergent arms of the feet, the feet include second bends located intermediate the first bends and the distal ends of the first and second parts and the feet converge toward the plane at the second bends to define convergent arms of the feet, and the distal ends of the first and second parts are in contact with each other along a line in the plane, so that the divergent arms and the convergent arms of the first and second parts define a stiffening case of the anchor for bearing loads applied when a construction element in which the anchor is partially embedded is lifted at the heads of the first and second parts.

2. The anchor according to claim 1, wherein the divergent arms form respective angles with the plane in a range from 45° to 80°.

3. The anchor according to claim 2, wherein the divergent arms form respective angles with the plane substantially equal to 45°, and the stiffening case defined by the divergent arms and the convergent arms has a rectangular shape in side view.

4. The anchor according to claim 1, wherein the heads of the first and second parts are in contact with each other at the plane.

5. The anchor according to claim 4, wherein the bodies of the first and second parts are joined to the heads of the first and second parts at third bends of the first and second parts, and the first and second parts diverge from the plane at the third bends to define first facets of the first and second parts.

6. The anchor according to claim 5, wherein the bodies of each of the first and second parts include fourth bends located intermediate the third bends and the feet of the first and second parts, and the bodies converge from the fourth bends toward the plane to define second facets of the first and second parts, the second facets joining the first facets to the feet of the first and second parts.

7. The anchor according to claim 5, wherein the bodies of each of the first and second parts include fourth bends located intermediate the third bends and the feet of the first and second parts, and the bodies of the first and second parts extend parallel to each other and spaced from the plane, from the fourth bends to the feet of the first and second parts.

8. The anchor according to claim 1, wherein each of the feet of the first and second parts includes a third bend located intermediate the first and second bends, and the feet of bend at the third bends to define intermediate arms joining the divergent arms to the convergent arms, with the intermediate arm substantially parallel to the plane so that the convergent arms are substantially perpendicular to the plane.

9. The anchor according to claim 8, wherein the divergent arms form respective angles with plane substantially equal to 70°.

10. The anchor according to claim 1, wherein the means for engagement comprises at least one orifice in each of the heads of the first and second parts.

11. The anchor according to claim 1, wherein the first and second parts are steel.

12. The anchor according to claim 1, comprising raised fins extending along a longitudinal edge of the bodies of each of the first and second parts, each fin forming a tilt angle with the respective body.

13. The anchor according to claim 12, comprising spaced apart ribs located at junctions of the raised fins and the bodies and stiffening the ribs relative to the bodies of the first and second parts.

14. The anchor according to claim 1 further including an extension element including at least two faces angularly aligned with the divergent arms, where in the extension element passes through the stiffening case of the foot and extends from both sides of the stiffening case, with of the faces contacting respective divergent arms.

* * * * *